US007150781B2

(12) United States Patent
Urata et al.

(10) Patent No.: US 7,150,781 B2
(45) Date of Patent: Dec. 19, 2006

(54) PYROPHOSPHORIC ACID BATH FOR USE IN COPPER-TIN ALLOY PLATING

(75) Inventors: Kazuya Urata, Saitama (JP); Kunio Tachibana, Saitama (JP); Naoyuki Oniwa, Saitama (JP); Mikiya Tajima, Saitama (JP); Yukio Ogawa, Saitama (JP)

(73) Assignee: Nihon New Chrome Co., Ltd., Tokyo (JP)

( * ) Notice: Subject to any disclaimer, the term of this patent is extended or adjusted under 35 U.S.C. 154(b) by 0 days.

(21) Appl. No.: 10/520,137

(22) PCT Filed: May 20, 2003

(86) PCT No.: PCT/JP03/06262

§ 371 (c)(1),
(2), (4) Date: Jan. 3, 2005

(87) PCT Pub. No.: WO2004/005528

PCT Pub. Date: Jan. 15, 2004

(65) Prior Publication Data

US 2005/0166790 A1 Aug. 4, 2005

(30) Foreign Application Priority Data

Jul. 5, 2002 (JP) ..... 2002-197597

(51) Int. Cl.
*B22F 7/00* (2006.01)

(52) U.S. Cl. ..... 106/1.18; 106/1.26; 428/646; 428/647; 428/648

(58) Field of Classification Search ..... 428/646; 106/1.18
See application file for complete search history.

(56) References Cited

U.S. PATENT DOCUMENTS 3,945,894 A 3/1976 Martin et al.
3,975,346 A * 8/1976 Bosso et al. ..... 523/414
4,289,812 A * 9/1981 Martin ..... 427/379
6,416,571 B1 * 7/2002 Kaneko et al. ..... 106/1.18

FOREIGN PATENT DOCUMENTS

EP 1 146 148 10/2001
EP 1146148 A2 * 10/2001
JP 10-102278 4/1998

OTHER PUBLICATIONS

EPO, "Notification of Transmittal of The ISR (PCT/ISA/220) and ISR (PCT/ISA/210)," EPO (Rijswijk), (Mar. 4, 2005).

* cited by examiner

*Primary Examiner*—Jennifer C. McNeil
*Assistant Examiner*—Gordon R. Baldwin
(74) *Attorney, Agent, or Firm*—Dennis G. LaPointe

(57) ABSTRACT

The invention relates to a pyrophosphoric acid bath for use in cyanogen-free copper-tin alloy plating that contains an additive (A) composed an amine derivative, an epihalohydrin and a glycidyl ether compound with ratios of epihalohydrin to glycidyl ether compound being 0.5–2 to 0.1–5 on mol basis, per 1 mol of the amine derivative, has a pH of 3 to 9, and optionally contains an additive (B) composed of an organic sulfonic acid and/or an organic sulfonic acid salt, and to a copper-tin alloy coating obtainable by using the bath. The invention provides a pyrophosphoric acid bath for use in copper-tin alloy plating of the cyanogen-free type utilizable on an industrial scale, particularly, capable of performing uniform treatment to exhibit low defective product generation rates even with the current density being incessantly changing between a high state and a low state, as a barrel plating method, and a copper-tin alloy coating obtainable by using the bath.

16 Claims, No Drawings

PYROPHOSPHORIC ACID BATH FOR USE IN COPPER-TIN ALLOY PLATING

RELATED APPLICATION

This application is a 35 USC 371 application of PCT/JP2003/006262 filed May 20, 2003, which takes priority from JP 2002-197597 filed Jul. 5, 2002.

TECHNICAL FIELD

The present invention relates to a cyanic ion-free pyrophosphoric acid bath for use in copper-tin alloy plating suitable for applications to ornamentation and costumery and surface treatment of electronic parts etc., in particular, to a pyrophosphoric acid bath for use in tin-copper alloy plating capable of obtaining a preferable coating even in plating in which the current density distribution at the time of plating is extremely wide from low current density to high current density as in the case of barrel plating, and to copper-tin alloy coating which can be obtained by using the pyrophosphoric acid bath.

BACKGROUND ART

Conventionally, nickel plating has been widely used as a surface treatment for ornamentation and costumery. However, it has been pointed out that the nickel plating has a problem of nickel allergy that causes skin eruption or inflammation to an individual who puts on an ornament having a nickel coating so that an alternative technology has been demanded. Also, tin-lead alloy plating containing lead has conventionally been widely used as a surface treatment for electronic parts. In consideration of the harmfulness of the lead contained therein to human bodies and the environment, new plating without the use of lead has been demanded.

Under the circumstances, copper-tin alloy plating has been reviewed in recent years.

Plating baths for use in industrial copper-tin alloy plating are mostly those containing cyanic ions such as a cyanogen-stannic acid bath and a cyanogen-pyrophosphoric acid bath. Due to a severe drainage treatment regulation, disposal of waste from those baths is costly. There is also a problem from the standpoint of operation in a safe environment. Therefore, a copper-tin alloy plating bath containing no cyanic ion (hereinafter, referred to simply as "cyanogen-free") is required.

Under the circumstances, the following pyrophosphoric acid baths have been proposed as cyanogen-free copper-tin alloy plating baths.

In JP 10-102278 A, there is proposed, as a cyanogen-free pyrophosphoric acid bath, a pyrophosphoric acid bath for use in copper-tin alloy plating that contains a reaction product of an amine derivative and an epihalohydrin in a 1:1 mole ratio and an aldehyde derivative and, when necessary, further uses a surface tension adjusting agent. Also, in JP 2001-295092 A (U.S. Pat. No. 6,416,571 B), there is proposed, as a cyanogen-free pyrophosphoric acid bath, a pyrophosphoric acid bath for use in copper-tin alloy plating that contains a reaction product of an amine derivative and an epihalohydrin in a 1:1 mole ratio and a cationic surfactant and, when necessary, further uses a surface tension adjusting agent and a bath stabilizer.

Conventionally, barrel plating has been used as a mass plating treatment method for small parts that are small in size and have no engagement hole. When barrel plating is performed on an industrial scale (in several kilograms (kg) or more), the pyrophosphoric acid baths used in the prior art give plated products with appearances (color tone, gloss, etc.) not completely uniform even for products that have been plated in the same barrel in the same plating chance and there have been problems that defective products caused by bad appearance are generated in ratios on the order of 20 to 50%. Also, removal of the generated defective products must be coped with by sheer numbers and the removed defective products must be replated, so that much labor and cost have been needed.

Therefore, an object of the present invention is to solve the above-mentioned problems of the prior art, to provide a pyrophosphoric acid bath for use in cyanogen-free copper-tin alloy plating that can be utilized on an industrial scale, in particular, a cyanogen-free pyrophosphoric acid bath for use in copper-tin alloy plating capable of performing uniform treatment and that exhibits a low defective product generation rate (hereinafter, in some cases referred to simply as "rejection rate") even in those applications where the state of current application is incessantly changing between a high current density state and a low current density state, as in the case of a barrel plating method, and a copper-tin alloy coating which can be obtained by using the pyrophosphoric acid bath.

DISCLOSURE OF THE INVENTION

To solve the problems of the prior art, the inventors of the present invention have conducted an intensive study on the relationship between the current density range in which a coating having a glossy, uniform appearance is obtained in a Hull cell test (hereinafter, referred to as "optimal current density range") and the defective product generation rate. As a result, they have found that the optimal current density ranges of the conventional pyrophosphoric acid baths were very narrow as compared with cyanogen-based copper-tin alloy plating baths and that broadening the optimal current density range, in particular, decreasing the current density on a Hull cell plate on the low current density part thereof where plating comes to have a gloss for the first time (hereinafter, referred to as "minimal gloss current density") on the side of the lower current density, can decrease the defective product generation rate.

Accordingly, the inventors of the present invention have made studies on the composition of a plating bath with an aim to broaden the optimal current density range thereof, in particular, decrease the minimal gloss current density thereof, and as a result they have found that use of a glycidyl ether compound in place of the aldehyde derivative described in JP 10-102278 A or the cationic surfactant described in JP 2001-295092 A can broaden the gloss range, in particular, on the low current density side, and can give rise to treated articles with a uniform color tone and appearance at high yields (low defective product generation rate) even in barrel plating. Thus, the present invention has been accomplished based on this finding.

Namely, the present invention provides the following pyrophosphoric acid baths for use in cyanogen-free copper-tin alloy plating and a copper-tin alloy coating which can be obtained by using the pyrophosphoric acid bath.

1. A pyrophosphoric acid bath for use in cyanogen-free copper-tin alloy plating, characterized by containing an additive (A) composed of an amine derivative, an epihalohydrin and a glycidyl ether compound.
2. A pyrophosphoric acid bath for use in cyanogen-free copper-tin alloy plating according to item 1 described above, in which the amine derivative includes one member or two or more members selected from the group consisting of ammonia, ethylenediamine, diethylenetriamine, piperazine, n-propylamine, 1,2-propanediamine, 1,3-propanediamine, 1-(2-aminoethyl)piperazine, 3-diethylaminopropylamine, dimethylamine, hexamethylenetetramine, tetraethylenepentamine, triethanolamine, hexamethylenediamine and isopropanolamine.

3. A pyrophosphoric acid bath for use in cyanogen-free copper-tin alloy plating according to item 1 described above, in which the amine derivative is piperazine or 1-(2-aminoethyl)piperazine.

4. A pyrophosphoric acid bath for use in cyanogen-free copper-tin alloy plating according to item 1 described above, in which ratios of the epihalohydrin and of the glycidyl ether in the additive (A) are 0.5 mol to 2 mol of the epihalohydrin and 0. 1 mol to 5 mol of the glycidyl ether compound, respectively, per 1 mol of the amine derivative.

5. A pyrophosphoric acid bath for use in cyanogen-free copper-tin alloy plating according to item 1 or 4 described above, in which the glycidyl ether compound in the additive (A) is a polyfunctional glycidyl ether compound having two or more functional groups in the molecule.

6. A pyrophosphoric acid bath for use in cyanogen-free copper-tin alloy plating according to items 1 or 4 described above, in which the glycidyl ether compound in the additive (A) is a polyglycidyl ether of a 0- to 2-mol ethylene glycol/epichlorohydrin adduct, represented by general formula (I)

$$R^1—O—CH_2—CH_2—O—R^2 \quad (I)$$

(wherein $R^1$ and $R^2$, which may be the same or different, each represent a group represented by the following formula

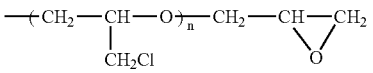

and n is 0 or 1).

7. A pyrophosphoric acid bath for use in cyanogen-free copper-tin alloy plating according to item 1 described above, further including an additive (B) composed of an organic sulfonic acid and/or an organic sulfonic acid salt.

8. A pyrophosphoric acid bath for use in cyanogen-free copper-tin alloy plating according to any one of items 1 to 7 described above, in which the plating bath has a pH of 3 to 9.

9. A copper-tin alloy coating which can be obtained by using the pyrophosphoric acid bath described in any one of items 1 to 8 above.

DETAILED DESCRIPTION OF THE INVENTION

Hereinafter, the present invention will be described in detail.

The pyrophosphoric acid bath of the present invention contains in addition to a conventionally known fundamental bath composition of a pyrophosphoric acid bath for use in copper-tin alloy plating, an additive (A) composed of an amine derivative, an epihalohydrin and a glycidyl ether compound and optionally an additive (B) composed of an organic sulfonic acid and/or an organic sulfonic acid salt.

The fundamental bath composition of the pyrophosphoric acid bath of the present invention contains an alkali metal pyrophosphate (potassium salt or sodium salt) for forming a water-soluble complex salt with a copper ion and a tin ion.

Examples of the copper ion source include at least one water-soluble copper salt selected from copper sulfate, copper nitrate, copper carbonate, copper methanesulfonate, copper sulfamate, copper 2-hydroxyethanesulfonate, copper 2-hydroxypropanesulfonate, copper chloride, copper pyrophosphate, and the like. Of these, copper pyrophosphate is preferred.

Further, examples of the tin ion source include at least one water-soluble tin salt selected from stannous pyrophosphate, stannous chloride, stannous sulfate, stannous acetate, stannous sulfamate, stannous gluconate, stannous tartrate, stannous oxide, sodium stannate, potassium stannate, stannous methanesulfonate, stannous 2-hydroxyethanesulfonate, stannous 2-hydroxypropanesulfonate, stannous borofluoride, and the like. Of these, stannous pyrophosphate is preferred.

The compounding amount of the water-soluble copper salt is preferably 0.05 g/l to 40 g/l, particularly 0.1 g/l to 5 g/l, as copper. On the other hand, the compounding amount of the water-soluble tin salt is preferably 1 g/l to 60 g/l, particularly preferably 3 g/l to 40 g/l, as tin.

If the concentrations of copper and tin are outside the above-mentioned ranges, respectively, the optimal current density range in which gloss is generated becomes narrow so that uniform and glossy coating cannot be obtained, thereby increasing the defective product generation rate.

Further, it is preferable that the water-soluble copper salt and the water-soluble tin salt are compounded such that copper:tin (molar ratio of metal moieties) is 1:0.05 to 300. More preferably, copper:tin (molar ratio of metal moieties) is 1:5 to 50.

The alkali metal pyrophosphate, which is a complexing agent, is desirably set in a concentration at which it has a ratio of the concentration of $[P_2O_7]$ to the concentration of [Sn+Cu] ($[P_2O_7]$/[Sn+Cu]) (hereinafter, referred to as "p ratio") of preferably 3 to 80, particularly preferably 5 to 50. If the p ratio is lower than 3, the alkali metal pyrophosphate forms a water-insoluble complex salt with copper or tin, so that a normal coating cannot be obtained. On the other hand, if the p ratio exceeds 80, the current efficiency is decreased so that such a p ratio is not only impractical but also causes burnt deposits in the coating so that the appearance of the coating is considerably deteriorated and hence is not preferable.

The alkali metal pyrophosphates include sodium pyrophosphate and/or potassium pyrophosphate. They may be used singly, or two or more of them may be used at the same time.

The additive (A) composed of an amine derivative, an epihalohydrin and a glycidyl ether compound used in the present invention is a mixture of the amine derivative, the epihalohydrin and the glycidyl ether compound and/or a reaction product obtained by reaction of a part of or the whole of them (hereinafter, in some cases referred to simply as "mixture and/or reaction product") and works as a brightener.

In plating using one or two compounds selected from epihalohydrin, amine derivative and glycidyl ether compound as a mixture and/or reaction product thereof, products of the plating are glossless, or if they have gloss, the optimal current density range is very narrow and the rejection rate is increased so that such plating is not suitable for use in the present invention.

The present invention using a mixture and/or reaction product of the above-mentioned three components can for the first time provide a copper-tin alloy plating having gloss and exhibiting a low defective product generation rate.

Examples of the amine derivative used in the additive (A) include ammonia, ethylenediamine, diethylenetriamine, piperazine, n-propylamine, 1,2-propanediamine, 1,3-propanediamine, 1- (2-aminoethyl) piperazine, 3-diethylaminopropylamine, dimethylamine, hexamethylenetetramine, tetraethylenepentamine, triethanolamine, hexamethylenediamine, isopropanolamine, and the like. These, as amine derivatives, may be used singly, or two or more of them may be used at the same time. Particularly preferred are piperazine and 1-(2-aminoethyl)piperazine.

The epihalohydrin includes epichlorohydrin and epibromohydrin, with epichlorohydrin being preferred.

Examples of the glycidyl ether-based compound include: monoglycidyl ethers such as methyl glycidyl ether, butyl glycidyl ether, 2-ethylhexyl glycidyl ether, decyl glycidyl ether, stearyl glycidyl ether, allyl glycidyl ether, phenyl glycidyl ether, p-sec-butylphenyl glycidyl ether, p-tert-butylphenyl glycidyl ether, and butoxypolyethylene glycolmonoglycidyl ether; and polyfunctional glycidyl ethers such as polyethylene glycol diglycidyl ether, polypropylene glycol diglycidyl ether, neopentyl glycol diglycidyl ether, trimethylolpropane polyglycidyl ether, sorbitol polyglycidyl ether, a polyglycidyl ether of a 0- to 2- mol ethylene glycol/epichlorohydrin adduct, a polyglycidyl ether that is an adduct of 0 to 1 mol of glycerin/epichlorohidrin. These may be used singly, or two or more of them may be used at the same time.

Among the glycidyl ether compounds, in particular, a polyfunctional glycidyl ether having two or more functional groups in the molecule is preferable. Further a polyglycidyl ether of a 0- to 2-mol ethylene glycol/epichlorohydrin adduct, represented by the following general formula (I)

$$R^1—O—CH_2—CH_2—O—R^2 \quad (I)$$

(wherein $R^1$ and $R^2$, which may be the same or different, each represent a group represented by the following formula

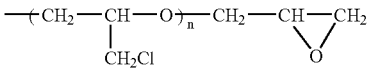

and n is 0 or 1) is preferable. For example, a polyglycidyl ether of a 0-mol ethylene glycol/epichlorohydrin adduct (n=0 in the general formula (I)) is ethylene glycol diglycidyl ether.

The compounding ratio of the amine derivative, the epihalohydrin and the glycidyl ether compound is preferably set to 0.5 mol to 2 mol of the epihalohydrin and 0.1 mol to 5 mol of the glycidyl ether compound, respectively, per 1 mol of the amine derivative.

The compounding ratio of the epihalohydrin of less than 0.5 mol per 1 mol of the amine derivative is not preferable since the optimal current density range becomes narrow so that when barrel plating is performed, the product rejection rate becomes high while the compounding ratio of the epihalohydrin exceeding 2 mol per 1 mol of the amine derivative is not preferable since the adhesion of the coating becomes deteriorated. On the other hand, the compounding ratio of the glycidyl ether compound of less than 0.1 mol per 1 mol of the amine derivative is not preferable since it becomes difficult to obtain a decrease in the minimal gloss current density so that when barrel plating is performed, the product rejection rate becomes high while the compounding ratio of the glycidyl ether compound exceeding 5 mol per 1 mol of the amine derivative is not preferable since the corrosion resistance and adhesion of the coating become deteriorated. A particularly desired compounding ratio is 0.75 mol to 1.25 mol of the epihalohydrin and 0.25 mol to 3 mol of the glycidyl ether compound per 1 mol of the amine derivative and more preferably 0.9 mol to 1.1 mol of the epihalohydrin and 0.5 mol to 2 mol of the glycidyl ether compound per 1 mol of the amine derivative.

In the additive (A), the epihalohydrin, the amine derivative and the glycidyl ether compound may be present in an unreacted state respectively or a part of or the whole of at least two kinds out of these may be reacted to form a new reaction product and exist therein in this state. It is preferred that at least a part of the epihalohydrin and the amine derivative react and desirably exist therein as a reaction product.

Note that although it is preferred that before they are added to a plating bath, the epihalohydrin, the amine derivative and the glycidyl ether compound in the additive (A) be mixed and reacted and the mixture or reaction product be added as the additive (A), only the glycidyl ether compound may be directly added to the plating bath without being premixed with the epihalohydrin and the amine derivative.

It is desirable that the addition amount of the additive (A) is accordingly selected the most appropriate amount without limitation, and as an active component to the plating bath preferably 0.005 g/l to 10 g/l, more preferably 0.01 g/l to 3 g/l. If the amount of the component (A) is less than the above range, alloy deposition tends to be spongy so that no glossy coating can be obtained. On the other hand, the amount of the component (A) exceeding the above range is not suitable for use in the present invention, since deterioration of the corrosion resistance and adhesion of the coating occur.

In the present invention, it is preferred that the additive (B) composed of an organic sulfonic acid and/or its salts be added to the bath as a bath stabilizer.

This prevents precipitation of copper powders in a solution owing to copper reduction as shown in the following reaction:

$$Sn^{2+}+Cu^{2+}\rightarrow Sn^{4+}+Cu$$

and contributes to solve the instability of tin ions, which is the primal problem of the pyrophosphoric acid bath for use in copper-tin alloy plating.

Note that, examples of the organic sulfonic acid and salts thereof include: alkanesulfonic acids such as methanesulfonic acid, ethanesulfonic acid, propanesulfonic acid, 2-propanesulfonic acid, butanesulfonic acid, 2-butanesulfonic acid, pentanesulfonic acid, hexanesolfonic acid, decanesulfonic acid, and dodecanesulfonic acid, and salts thereof; aromatic sulfonic acids such as benzenesulfonic acid, toluenesulfonic acid, xylenesulfonic acid, and phenolsulfonic acid, and salts thereof; and alkanolsulfonic acids such as isethionic acid (2-hydroxyethane-1-sulfonic acid), 2-hydroxypropane-1-sulfonic acid, 1-hydroxypropane-2-sulfonic acid, 3-hydroxypropane-1-sulfonic acid, 2-hydroxybutane-1-sulfonic acid, 4-hydroxybutane-1-sulfonic acid, 2-hydroxypentane-1-sulfonic acid, 2-hydroxyhexane-1-sulfonic acid, 2-hydroxydecane-1-sulfonic acid, and 2-hydroxydodecane-1-sulfonic acid, and salts thereof. These may be used singly, or two or more of them may be used at the same time. Of these, methanesulfonic acid is the most suitable for use.

The addition amount of the organic sulfonic acid and/or its salts to a plating bath is not particularly limited but is preferably 20 g/l to 100 g/l.

In the present invention, as further additives, surfactants such as a cationic surfactant, an anionic surfactant, a nonionic surfactant, an amphoteric surfactant or the like may be used as appropriate. These additives have the effect of broadening the optimal current density range, in particular in a high current density side, and are not only effective in plating items that tend to generate burnt deposits or scorches in the coating but are also effective in promoting the separation of gas from the coating to prevent formation of pits, thereby obtaining smoother plated films.

Examples of the cationic surfactant include dodecyltrimethylammonium salt, hexadecyltrimethylammonium salt, octadecyltrimethylammonium salt, dodecyldimethylethylammonium salt, octadecenyldimethylethylammonium salt, dodecyldimethylammonium betaine, octadecyldimethylammmonium betaine, dimethylbenzyldodecylammonium salt, hexadecyldimethylbenzylammonium salt, octadecyldimethylbenzylammonium salt, trimethylbenzylammonium salt, triethylbenzylammonium salt, hexadecylpyridinium salt, dodecylpyridinium salt, dodecylpicolinium salt, dodecylimidazolinium salt, oleylimidazolinium salt, octadecylamine acetate, dodecylamine acetate, and the like.

Examples of the anionic surfactant include alkylcarboxylate, alkylsulfate, alkylphosphate, polyoxyethylene alkyl ether sulfate, polyoxyethylene alkylphenyl ether sulfate, alkylbenzenesulfonate, (poly)alkylnaphthalenesulfonate, and the like.

Examples of the nonionic surfactant include polyoxyalkylene adducts(including a block copolymer of oxyethylene and oxypropylene) such as polyalkylene glycol, higher alcohol, phenol, alkylphenol, naphthol, alkylnaphthol, bisphenols, a styrenated phenol, fatty acid, aliphatic amine, sulfonamide, phosphoric acid, polyhydric alcohol, and glucoxide. More specifically, they include nonylphenol polyethoxylate, octylphenol polyethoxylate, dodecyl alcohol polyethoxylate, a styrenated phenol polyethoxylate, a polyoxyethylene/polyoxypropylene block copolymer, cumylphenol polyethoxylate, and the like.

As the amphoteric surfactant, those of various types may be used, examples of which include betaine, sulfobetaine, aminocarboxylic acid, imidazolinium betaine, and the like. In addition, a sulfated or sulfonated adduct of a condensation product of ethylene oxide and/or propylene oxide with alkylamine or diamine may also be used.

Further, by use of fluorine-contained surfactants obtained by replacing at least one hydrogen in the above-mentioned hydrocarbon surfactants (of the amphoteric, nonionic, cationic, or anionic type) with fluorine, addition of even a much smaller amount of fluorine-contained surfactant than that of the hydrocarbon surfactant provides the effect of addition that is identical to or much better than that obtained by the hydrocarbon surfactant and in addition increases the bath stability of the plating bath.

The addition amount of the surfactant to a plating bath is preferably 0.001 g/l to 5 g/l, more preferably 0.005 g/l to 3 g/l, and particularly preferably 0.01 g/l to 1 g/l. The content of the surfactant of less than 0.001 g/l is not preferable since no effect is obtained by the addition of the surfactant. On the other hand, the content of the surfactant of more than 5 g/l is not preferable since no better effect can be obtained by the addition thereof, which is not only economically disadvantageous but also causes vigorous foaming of the plating bath and thus has adverse influences on the environment.

Further, to the above-mentioned plating bath may be added as needed additives such as stress reducing agents, electroconductivity aids, antioxidants, defoaming agents, pH buffers, and other brighteners and the like after appropriate selection.

Examples of the stress reducing agent include naphtholsulfonic acid, saccharin, and sodium 1,5-naphthalenedisulfonate. The electroconductivity aids includes acids such as hydrochloric acid, sulfuric acid, acetic acid, nitric acid, sulfamic acid, pyrophosphoric acid, and boric acid, and salts thereof such as ammonium salts, sodium salts, potassium salts, organic amine salts, and the like.

The antioxidant includes hydroxyphenyl compounds such as phenol, catechol, resorcin, hydroquinone, and pyrogallol, as well as α- or β-naphthol, phloroglucin, L-ascorbic acid, sorbitol, erythorbic acid, and the like. The pH buffer includes: sodium or potassium acetate; sodium, potassium, or ammonium borate; sodium or potassium formate; sodium or potassium tartrate etc.; sodium, potassium or ammonium dihydrogen phosphate etc.

As the defoaming agent and other brighteners, those commercially available defoaming agents for use in copper plating, tin plating, copper-tin alloy plating and general plating may be utilized after appropriate selection.

In the present invention, it is desirable that the pH of the plating bath be adjusted to the range of 3 to 9, more preferably the range of 6 to 8. If the pH is less than 3, not only does the minimum gloss current density become high and the rejection rate increase but also the coating to be obtained will have a nonuniform and rough surface. On the other hand, if the pH of the plating bath exceeds 9, not only does the optimal current density range become narrow and the rejection rate increase but also, the stability of the plating bath deteriorates so that precipitates such as hydroxides of metals tend to be formed.

Examples of the pH adjuster for adjusting the plating bath to the above-mentioned pH include ammonia, sodium hydroxide, potassium hydroxide, hydrochloric acid, sulfuric acid, acetic acid, citric acid, organic sulfonic acid, and condensed phosphoric acid.

The method for preparing the plating bath of the present invention is not particularly limited; however, the objective plating bath can be obtained, for example, by dissolving a water-soluble copper salt and a water-soluble tin salt in an aqueous solution having dissolved therein an alkali metal salt and then compounding the additive (A) and the additive (B) therewith and optionally compounding other additives, with finally adjusting the obtained mixture to a predetermined pH.

The plating bath of the present invention can be advantageously used, in particular, in applications to plating methods in which the state of current application is incessantly changing between a higher current density state and a lower current density state, such as a barrel plating method. However, the method of plating is not limited and plated films having excellent quality and performance can be obtained in other known plating methods such as a rack plating method and a high speed plating method. Also, the method of barrel plating is not limited and may have applicability to any known methods such as a rotary barrel method, a swingy barrel method, a titled barrel method and a vibratory barrel method.

The bath temperature of the plating bath is not particularly limited but preferably set to 10° C. to 60° C. At low temperatures below 10° C., the deposition efficiency tends to be decreased while at high temperatures above 60° C., it becomes difficult to stabilize the composition of the plating bath due to evaporation of the plating bath and promotion of the oxidation of stannous ions. A particularly preferred plating-bath temperature is 20° C. to 40° C.

As for the current density, an optimal current density may be selected and set as appropriate depending on the plating method to be used, the shape of an article to be plated, the composition of the objective composition of plating, the appearance of a finished article, and the like. For example, in the case of barrel plating and rack plating, the current density is 0.03 A/dm$^2$ to 10 A/dm$^2$ while in the case of high speed plating in which a strong flow of the bath is involved, such as jet plating, higher current densities of up to about 50 A/dm$^2$ can be utilized.

As the anode, known anodes that can be utilized in copper-tin alloy plating, such as soluble anodes (for example, tin anodes, copper-tin alloy anodes, and the like) and insoluble anodes (for example, platinum anodes, titanium anodes, titanium-platinum anodes, oxide-coated anodes such as iridium oxide-coated titanium electrodes, and the like) may be used.

The article to be plated is not particularly limited and any article to which current can be applied may be used. Examples of such articles include metal materials such as iron, steel, copper, and brass, or articles made of ceramic or plastic materials to which any kind of metal plating has been preliminarily applied, etc.

The pyrophosphoric acid bath according to the present invention can be advantageously used in plating for costumery and ornamentation and plating of electronic or electric parts and the like. There is no limitation on its application to other uses.

BEST MODE FOR CARRYING OUT THE INVENTION

Hereinafter, the present invention will be described by referring to examples and comparative examples. However, the present invention should not be considered to be limited by the following description.

(1) Preparation of Additive (A) Solution

By using piperazine as an amine derivative, epichlorohydrin as an epihalohydrin, and ethylene glycol diglycidyl ether as a glycidyl ether compound, the following additives A-1 to A-13 were prepared.

Additive (A-1)

300 ml of water and 1 mol of piperazine were charged in a sealable vessel equipped with a thermometer, a coiled condenser and a stirrer and was stirred and dissolved to obtain an aqueous piperazine solution (a). On the other hand, 1 mol of epichlorohydrin and 1 mol of ethylene glycol diglycidyl ether were preliminarily mixed in a separate vessel to obtain a mixture (b). The mixture (b) was charged in the piperazine solution (a) portionwise while stirring. On this occasion, the liquid temperature went up; however, this caused no problem since time intervals between charging of the mixture (b) were adjusted such that the temperature of the solution did not exceed 80° C. at. the maximum and was kept in the range of 65° C. to 80° C. After the total quantity of the mixture (b) was charged, the temperature of the solution was retained and the solution was stirred for one hour. Thereafter, the solution was cooled down to 40° C. or less. Finally the total quantity of the solution was adjusted to be two liters by addition of water to obtain an additive A-1.

Additive (A-2) to Additive (A-13)

Additives were prepared in the same manner as in the case of the additive A-1 except that the compounding amounts of the piperazine, the epichlorohydrin and the glycidyl ether compound were changed. They were named additives A-2 to A-13, respectively.

TABLE 1

| | Components of Additive (A) | | | | | |
|---|---|---|---|---|---|---|
| | Piperazine | | Epichlorohydrin | | Ethylene glycol diglycidyl ether | |
| No | mol | g | mol | g | mol | g |
| A-1 | 1.0 | 86.1 | 1.0 | 92.5 | 1.0 | 150.2 |
| A-2 | 1.0 | 86.1 | 0.6 | 55.5 | 1.0 | 150.2 |
| A-3 | 1.0 | 86.1 | 0.8 | 74.0 | 1.0 | 150.2 |
| A-4 | 1.0 | 86.1 | 1.2 | 111.0 | 1.0 | 150.2 |
| A-5 | 1.0 | 86.1 | 1.8 | 166.5 | 1.0 | 150.2 |
| A-6 | 1.0 | 86.1 | 1.0 | 92.5 | 0.2 | 30.0 |
| A-7 | 1.0 | 86.1 | 1.0 | 92.5 | 0.3 | 45.1 |
| A-8 | 1.0 | 86.1 | 1.0 | 92.5 | 2.5 | 375.4 |
| A-9 | 1.0 | 86.1 | 1.0 | 92.5 | 4.0 | 600.7 |
| A-10 | 1.0 | 86.1 | 1.0 | 92.5 | — | — |
| A-11 | 1.0 | 86.1 | — | — | 1.0 | 150.2 |
| A-12 | 1.0 | 86.1 | 1.0 | 92.5 | 5.5 | 825.9 |
| A-13 | 1.0 | 86.1 | 2.5 | 231.3 | 1.0 | 150.2 |

(2) Additive (B)

Methanesulfonic acid (3) Other Additives (Surfactants and the Like)

(a) Perfluoroalkyltrimethylammonium salt (b) 2,4,7,9-tetramethyl-5-decyn-4,7-diol di (polyoxyethylene) ether (4) Plating Bath In an aqueous solution having dissolved therein a predetermined amount of potassium pyrophosphate were dissolved predetermined amounts of copper pyrophosphate and stannous pyrophosphate, and then predetermined amounts shown in Table 2 of one of the additives (A-1) to (A-13) as well as of the additive (B) and of the other additives were compounded therein. Finally, the resultant was adjusted to a predetermined pH with an aqueous potassium hydroxide solution and/or polyphosphoric acid to prepare plating baths. Table 2 shows the compositions of the plating baths thus prepared. In addition, each plating bath was measured for optimal current density range and minimal gloss current density by the Hull cell test method and evaluated based on the standards described below. In all, Table 2 shows these results as well.

Note that the baths shown by 35 and 36 in Table 2 were baths described in Example 1 of JP 10-102278 A and Example 1 of JP 2001-295092 A, prepared based on the descriptions in these publications, respectively.

TABLE 2

| | Plating Bath | | | | | | | | | | |
|---|---|---|---|---|---|---|---|---|---|---|---|
| | Solution of the additive (A) | | Additive (B) | Additive (C) | | Potassium pyrophosphate | Copper pyrophosphate | Stannous pyrophosphate | | Optimal gloss | Minimal |
| No. | Kind | Concentration (g/l) *1 | Concentration (g/l) | Kind | Concentration (g/l) | Concentration (g/l) | Concentration (g/l) *2 | Concentration (g/l) *2 | pH of bath | current density range | gloss current density |
| 1 | A-1 | 0.02 | 60 | a | 0.05 | 300 | 0.2 | 4.6 | 7.3 | ◎ | ◎ |
| 2 | A-2 | 0.02 | 60 | a | 0.05 | 300 | 0.2 | 4.6 | 7.3 | Δ | ○ |
| 3 | A-3 | 0.02 | 60 | a | 0.05 | 300 | 0.2 | 4.6 | 7.3 | ○ | ◎ |
| 4 | A-4 | 0.02 | 60 | a | 0.05 | 300 | 0.2 | 4.6 | 7.3 | ◎ | ◎ |
| 5 | A-5 | 0.02 | 60 | a | 0.05 | 300 | 0.2 | 4.6 | 7.3 | ◎ | ◎ |
| 6 | A-6 | 0.02 | 60 | a | 0.05 | 300 | 0.2 | 4.6 | 7.3 | ○ | Δ |
| 7 | A-7 | 0.02 | 60 | a | 0.05 | 300 | 0.2 | 4.6 | 7.3 | ◎ | ○ |
| 8 | A-8 | 0.02 | 60 | a | 0.05 | 300 | 0.2 | 4.6 | 7.3 | ◎ | ◎ |
| 9 | A-9 | 0.02 | 60 | a | 0.05 | 300 | 0.2 | 4.6 | 7.3 | ◎ | ◎ |
| 10 | A-10 | 0.02 | 60 | a | 0.05 | 300 | 0.2 | 4.6 | 7.3 | Δ | X |
| 11 | A-11 | 0.02 | 60 | a | 0.05 | 300 | 0.2 | 4.6 | 7.3 | X | Δ |
| 12 | A-12 | 0.02 | 60 | a | 0.05 | 300 | 0.2 | 4.6 | 7.3 | ◎ | ○ |
| 13 | A-13 | 0.02 | 60 | a | 0.05 | 300 | 0.2 | 4.6 | 7.3 | ○ | ◎ |
| 14 | — | — | 60 | a | 0.05 | 300 | 0.2 | 4.6 | 7.3 | X | X |
| 15 | A-1 | 0.003 | 60 | a | 0.05 | 300 | 0.2 | 4.6 | 7.3 | Δ | Δ |
| 16 | A-1 | 0.007 | 60 | a | 0.05 | 300 | 0.2 | 4.6 | 7.3 | ○ | ○ |
| 17 | A-1 | 1.0 | 60 | a | 0.05 | 300 | 0.2 | 4.6 | 7.3 | ◎ | ◎ |
| 18 | A-1 | 3.0 | 60 | a | 0.05 | 300 | 0.2 | 4.6 | 7.3 | ◎ | ◎ |
| 19 | A-1 | 7.0 | 60 | a | 0.05 | 300 | 0.2 | 4.6 | 7.3 | ◎ | ◎ |
| 20 | A-1 | 9.8 | 60 | a | 0.05 | 300 | 0.2 | 4.6 | 7.3 | ◎ | ◎ |
| 21 | A-1 | 0.02 | 60 | — | — | 300 | 0.2 | 4.6 | 7.3 | ○ | ◎ |
| 22 | A-1 | 0.02 | 60 | b | 1.0 | 300 | 0.2 | 4.6 | 7.3 | ◎ | ◎ |
| 23 | A-1 | 0.02 | 60 | a | 0.05 | 300 | 0.2 | 4.6 | 2.0 | ◎ | Δ |
| 24 | A-1 | 0.02 | 60 | a | 0.05 | 300 | 0.2 | 4.6 | 5.0 | ◎ | ○ |
| 25 | A-1 | 0.02 | 60 | a | 0.05 | 300 | 0.2 | 4.6 | 7.0 | ◎ | ◎ |
| 26 | A-1 | 0.02 | 60 | a | 0.05 | 300 | 0.2 | 4.6 | 8.0 | ◎ | ◎ |
| 27 | A-1 | 0.02 | 60 | a | 0.05 | 300 | 0.2 | 4.6 | 8.7 | ○ | ◎ |
| 28 | A-1 | 0.02 | 60 | a | 0.05 | 300 | 0.2 | 4.6 | 9.0 | Δ | ◎ |
| 29 | A-1 | 0.02 | 60 | a | 0.05 | 300 | 0.2 | 4.6 | 10.0 | Precipitates occur in the plating bath and plating was impossible | |
| 30 | A-1 | 0.02 | — | a | 0.05 | 300 | 0.2 | 4.6 | 7.3 | ◎ | ◎ |
| 31 | A-1 | 0.02 | 50 | a | 0.05 | 300 | 0.2 | 6.5 | 7.2 | ◎ | ◎ |
| 32 | A-1 | 0.02 | 25 | a | 0.05 | 300 | 0.4 | 7.0 | 7.2 | ◎ | ◎ |
| 33 | A-1 | 0.02 | 75 | a | 0.05 | 300 | 1.0 | 17 | 7.2 | ◎ | ◎ |
| 34 | A-1 | 0.02 | 90 | a | 0.05 | 300 | 0.4 | 7.0 | 7.2 | ◎ | ◎ |
| 35 | Plating bath according to Example 1 of JP 10-102278 A | | | | | | | | | Δ | X |
| 36 | Plating bath according to Example 1 of JP 2001-295092 A | | | | | | | | | Δ | X |

*1: Concentration of the active component in the additive (A) in the plating bath (taking the additive (A) as 100%) (not the concentration of the solution of the additive (A))
*2: Concentration as a metal component Measurement of Optimal Current Density Range Hull cell tests were performed by using a brass-made Hull cell plate (100×65 mm) as a test piece and a 267-ml Hull cell as a Hull cell tank at a current of 2 A×5 minutes, and from the glossy area of the Hull cell plate after plating, the current density range in which the coating on the Hull cell plate had a continuous glossy appearance (optimal current density range) was measured and evaluated based on the following standards.

◎: Not lower than 7 A/dm$^2$

○: Not lower than 5 A/dm$^2$ and less than 7 A/dm$^2$

Δ: Not lower than 3 A/dm$^2$ and less than 5 A/dm$^2$

×: Less than 3 A/dm$^2$

Measurement of Minimal Gloss Current Density

Hull cell tests were performed by using a brass-made Hull cell plate (100×65 mm) as a test piece and a 267-ml Hull cell as a Hull cell tank at a current of 0.5A×10 minutes, the glossy area of the Hull cell plate after plating was observed, and the current density at which the coating on the Hull cell plate on its lower current density side first came to have a gloss (minimal gloss current density) was measured and evaluated based on the following standards.

◎: Less than 0.5 A/dm$^2$

○: Not lower than 0.5 A/dm$^2$ and less than 0.8 A/dm$^2$

Δ: Not lower than 0.8 A/dm$^2$ and less than 1.2 A/dm$^2$

×: Not lower than 1.2 A/dm$^2$.

Copper-Tin Alloy Plating 15 kg of brass-made stud members (trade name: 16 Duo (manufactured by YKK Newmax Co., Ltd.)) were charged in a barrel and immersion degreasing (ACE CLEAN 5300 (manufactured by Okuno Chemical Industries Co., Ltd.): 60 g/l, 50° C., 12 minutes) and rinsing with water were performed. Thereafter, electrolytic degreasing (ACE CLEAN 5300 (manufactured by Okuno Chemical Industries Co., Ltd.): 100 g/l, 50° C., 5V, 12 minutes) and rinsing with water were further performed. Then, the stud members were immersed in a 3.5% hydrochloric acid solution for 6 minutes and rinsed with water, and plating was performed in the plating bath having the composition shown in Table 2 at 30° C. and at a current density of 0.15 A/dm$^2$ for 24 minutes. After rinsing, the stud members were dried with hot air at 100° C. to obtain plated products of Examples 1 to 36.

The color tone, rejection rate, corrosion resistance, and adhesion of the plated products were evaluated by the following evaluation methods and Table 3 shows a summary of the results thereof.

[Color Tone]

Presence or absence of gloss and the color tone of the plated products were visually evaluated.

[Defective Product Generation Rate (Rejection Rate)]

All of the 15-kg plated products were uniformly arranged portion wise on a jig and then the appearance of the coatings were visually observed, thereby taking out those products having different color tones and gloss to sort out defective products. After performing this for the total amount thereof, the weight of the defective products thus sorted out was measured and calculated as (rejection rate (%)=(weight (g) of product having a defective appearance 15000 (g))×100), and evaluated based on the following evaluation standards.

◎: Less than 2%

○: Not lower than 2% and less than 7%

Δ: Not lower than 7% and less than 20%

×: Not lower than 20%

[Corrosion Resistance]

Constant-temperature-constant-humidity tests (60° C., 98% RH) were performed and evaluations were made by the presence or absence of discoloration in the appearance after 20 hours.

◎: No discoloration

○: More than 0% and not more than 5% of the surface area was discolored.

Δ: More than 5% and not more than 25% of the surface area was discolored.

×: Not more than 25% of the surface area was discolored.

[Adhesion]

Plated products were crushed with a pair of pincers and the presence or absence of peeling of the coatings at that time was visually evaluated.

○: No peeling of the coating

Δ: Slight peeling of the coating

×: Considerable peeling of the coating

TABLE 3

| | | | Quality and performance of coating | | | |
|---|---|---|---|---|---|---|
| | No. | Plating Bath *1 | Color tone | Rejection rate | Corrosion resistance | Adhesion test |
| Example | 1 | 1 | Glossy, silver white | ◎ | ◎ | ○ |
| Example | 2 | 2 | Glossy, silver white | Δ | ◎ | ○ |
| Example | 3 | 3 | Glossy, silver white | ○ | ◎ | ○ |
| Example | 4 | 4 | Glossy, silver white | ◎ | ○ | ○ |
| Example | 5 | 5 | Glossy, silver white | ◎ | ○ | Δ |
| Example | 6 | 6 | Glossy, silver white | Δ | ◎ | ○ |
| Example | 7 | 7 | Glossy, silver white | ○ | ◎ | ○ |
| Example | 8 | 8 | Glossy, silver white | ◎ | ○ | ○ |
| Example | 9 | 9 | Glossy, silver white | ◎ | Δ | Δ |
| Comparative Example | 10 | 10 | Glossy, white to yellowish white | X | ◎ | ○ |
| Comparative Example | 11 | 11 | Glossy, white to yellowish white | X | ◎ | X |
| Example | 12 | 12 | Glossy, silver white | ○ | Δ | Δ |
| Example | 13 | 13 | Glossy, silver white | ○ | Δ | Δ |
| Comparative Example | 14 | 14 | Glossless, white | X | X | X |
| Example | 15 | 15 | Glossy, silver white | Δ | ◎ | Δ |
| Example | 16 | 16 | Glossy, silver white | ○ | ◎ | ○ |
| Example | 17 | 17 | Glossy, silver white | ◎ | ◎ | ○ |
| Example | 18 | 18 | Glossy, silver white | ◎ | ◎ | ○ |
| Example | 19 | 19 | Glossy, silver white | ◎ | ○ | ○ |
| Example | 20 | 20 | Glossy, silver white | ◎ | Δ | Δ |
| Example | 21 | 21 | Glossy, silver white | ○ | ◎ | ○ |
| Example | 22 | 22 | Glossy, silver | ◎ | ◎ | ○ |
| Example | 23 | 23 | Glossy, silver white | Δ | ○ | ○ |
| Example | 24 | 24 | Glossy, silver white | ○ | ◎ | ○ |
| Example | 25 | 25 | Glossy, silver white | ◎ | ◎ | ○ |
| Example | 26 | 26 | Glossy, silver white | ◎ | ◎ | ○ |
| Example | 27 | 27 | Glossy, silver white | ○ | ◎ | ○ |
| Example | 28 | 28 | Glossy, silver white | Δ | ○ | Δ |
| Comparative Example | 29 | 29 | Precipitates occur in the plating bath and plating was impossible | | | |
| Example | 30 | 30 | Glossy, silver white | ◎ | ◎ | ○ |
| Example | 31 | 31 | Glossy, silver white | ◎ | ◎ | ○ |
| Example | 32 | 32 | Glossy, silver white | ◎ | ◎ | ○ |
| Example | 33 | 33 | Glossy, silver white | ◎ | ◎ | ○ |
| Example | 34 | 34 | Glossy, silver white | ◎ | ◎ | ○ |

TABLE 3-continued

| | Quality and performance of coating | | | | | |
|---|---|---|---|---|---|---|
| | No. | Plating Bath *1 | Color tone | Rejection rate | Corrosion resistance | Adhesion test |
| Comparative Example | 35 | 35 | Glossy, white to yellowish white | X | ◎ | ○ |
| Comparative Example | 36 | 36 | Glossy, white to yellowish white | X | ◎ | ○ |

*1: The plating bath described in Table 2

INDUSTRIAL APPLICABILITY

The present invention provides a pyrophosphoric acid bath for use in copper-tin alloy plating of the cyanogen-free type that can be utilized on an industrial scale and, in particular, that is capable of performing uniform treatment and that exhibits low defective product generation rates even in those applications where the state of current application is incessantly changing between a high current density state and a low current density state, such as in the case of a barrel plating method.

The invention claimed is:

1. A pyrophosphoric acid bath for use in cyanogen-free copper-tin alloy plating, characterized by containing a copper ion, a tin ion, an alkali metal pyrophosphate and an additive (A) composed of an amine derivative, an epihalohydrin and a glycidyl ether compound.

2. A pyrophosphoric acid bath for use in cyanogen-free copper-tin alloy plating according to claim 1, wherein the amine derivative comprises one member, or two or more members selected from the group consisting of ammonia, ethylenediamine, diethylenetriamine, piperazine, n-propylamine, 1,2-propanediamine, 1,3-propanediamine, 1-(2-aminoethyl)piperazine, 3-diethylaminopropylamine, dimethylamine, hexamethylenetetramine, tetraethylenepentamine, triethanolamine, hexamethylenediamine and isopropanolamine.

3. A pyrophosphoric acid bath for use in cyanogen-free copper-tin alloy plating according to claim 1, wherein the amine derivative is piperazine or 1-(2-aminoethyl)piperazine.

4. A pyrophosphoric acid bath for use in cyanogen-free copper-tin alloy plating according to claim 1, wherein ratios of the epihalohydrin and of the glycidyl ether compound in the additive (A) are 0.5 mol to 2 mol of the epihalohydrin and 0.1 mol to 5 mol of the glycidyl ether compound, respectively, per 1 mol of the amine derivative.

5. A pyrophosphoric acid bath for use in cyanogen free copper-tin alloy plating according to claim 1, wherein the glycidyl ether compound in the additive (A) is a polyfunctional glycidyl ether compound having two or more functional groups in the molecule.

6. A pyrophosphoric acid bath for use in cyanogen-free copper-tin alloy plating according to claim 1, wherein the glycidyl ether compound in the additive (A) is a polyglycidyl ether of an adduct of ethylene glycol added with 0 to 2 mol epichlorohydrin, represented by general formula (I)

$$R^1—O—CH_2—CH_2—O—R^2 \quad (I)$$

(wherein $R^1$ and $R^2$, which may be the same or different, each represent a group represented by the following formula

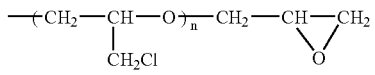

and n is 0 or 1).

7. A pyrophosphoric acid bath for use in cyanogen-free copper-tin alloy plating according to claim 1, further comprising an additive (B) composed of an organic sulfonic acid and/or an organic sulfonic acid salt.

8. A pyrophosphoric acid bath for use in cyanogen-free copper-tin alloy plating according to claim 1, wherein the plating bath has a pH of 3 to 9.

9. A coating obtained by using a pyrophosphoric acid bath for use in cyanogen-free copper-tin alloy plating, characterized by containing a copper ion, a tin ion, an alkali metal pyrophosphate and an additive (A) composed of an amine derivative, an epihalohydrin and a glycidyl ether compound; wherein a substrate to be coated is immersed in said bath and subsequently subjected to an electrical current to obtain said copper-tin alloy coating.

10. The copper-tin alloy coating according to claim 9, wherein the amine derivative comprises one member, or two or more members selected from the group consisting of ammonia, ethylenediamine, diethylenetriamine, piperazine, n-propylamine, 1,2-propanediamine, 1,3-propanediamine, 1-(2-aminoethyl)piperazine, 3-diethylaminopropylamine, dimethylamine, hexamethylenetetramine, tetraethylenepentamine, triethanolamine, hexamethylenediamine and isopropanolamine.

11. The copper-tin alloy coating according to claim 9, wherein the amine derivative is piperazine or 1-(2-aminoethyl)piperazine.

12. The copper-tin alloy coating according to claim 9, wherein ratios of the epihalohydrin and of the glycidyl ether compound in the additive (A) are 0.5 mol to 2 mol of the epihalohydrin and 0.1 mol to 5 mol of the glycidyl ether compound, respectively, per 1 mol of the amine derivative.

13. The copper-tin alloy coating according to claim 9, wherein the glycidyl ether compound in the additive (A) is a polyfunctional glycidyl ether compound having two or more functional groups in the molecule.

14. The copper-tin alloy coating according to claim 9, wherein the glycidyl ether compound in the additive (A) is a polyglycidyl ether of an adduct of ethylene glycol added with 0 to 2 mol epichlorohydrin, represented by general formula (I)

$$R^1—O—CH_2—CH_2—O—R^2 \quad (I)$$

(wherein $R^1$ and $R^2$, which may be the same or different, each represent a group represented by the following formula

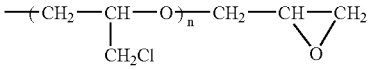

and n is 0 or 1).

15. The copper-tin alloy coating according to claim 9, wherein the pyrophosphoric acid bath further comprises an additive (B) composed of an organic sulfonic acid and/or an organic sulfonic acid salt.

16. The copper-tin alloy coating according to claim 9, wherein the plating bath has a pH of 3 to 9.

* * * * *